US006254295B1

(12) United States Patent
Cheng

(10) Patent No.: US 6,254,295 B1
(45) Date of Patent: Jul. 3, 2001

(54) DUAL-PURPOSE PEN

(75) Inventor: Jason Cheng, San-Chung (TW)

(73) Assignee: Ding Ares Enterprise Co., Ltd., Taipei (TW)

( * ) Notice: Subject to any disclaimer, the term of this patent is extended or adjusted under 35 U.S.C. 154(b) by 0 days.

(21) Appl. No.: 09/655,428

(22) Filed: Sep. 5, 2000

(51) Int. Cl.[7] ..... B43K 27/00
(52) U.S. Cl. ..... 401/30; 401/195; 401/29
(58) Field of Search ..... 401/32, 33, 29, 401/30, 195

(56) References Cited

U.S. PATENT DOCUMENTS 2,103,417 * 12/1937 Haack ..... 401/30
2,883,968 * 4/1959 Vertiz ..... 401/30
3,288,116 * 11/1966 Poritz ..... 401/30
3,985,455 * 10/1976 Wahlberg ..... 401/30

* cited by examiner

*Primary Examiner*—David J. Walczak
(74) *Attorney, Agent, or Firm*—Fei-Fei Chao; Venable, Baetjer, Howard & Civiletti, LLP

(57) ABSTRACT

A dual-purpose pen has a barrel, a cap engaged with the barrel, and a ball point that is extendable from the end of the barrel, and a key-pressing point that is extendable from the end of the cap. The pen can be used for writing when the ball point is extended and for pressing keys when the key-pressing point is extended.

4 Claims, 4 Drawing Sheets

DUAL-PURPOSE PEN

BACKGROUND OF THE INVENTION

1. Field of the Invention

The present invention is related to a pen, and more particularly to a dual-purpose pen which can be used as a general ballpoint pen for writing or a pen to press keys on a notebook computer or the like.

2. Description of Related Art

A pen is used to press keys on a notebook computer, electric calculator or the like, which are too small to be individually pressed by a user's finger. A conventional pen to press keys is unable to be used for writing. If the user wants to write something, he or she must look for an instrument for writing.

Therefore, an objective of the present invention is to provide a dual-purpose pen to mitigate and/or obviate the aforementioned problem.

SUMMARY OF THE INVENTION

The main objective of the invention is to provide a dual-purpose pen which can be used for writing or pressing small keys on a notebook computer or the like.

Other objects, advantages and novel features of the invention will become more apparent from the following detailed description when taken in conjunction with the accompanying drawings.

DETAILED DESCRIPTION OF THE PREFERRED EMBODIMENT

Figure 1:
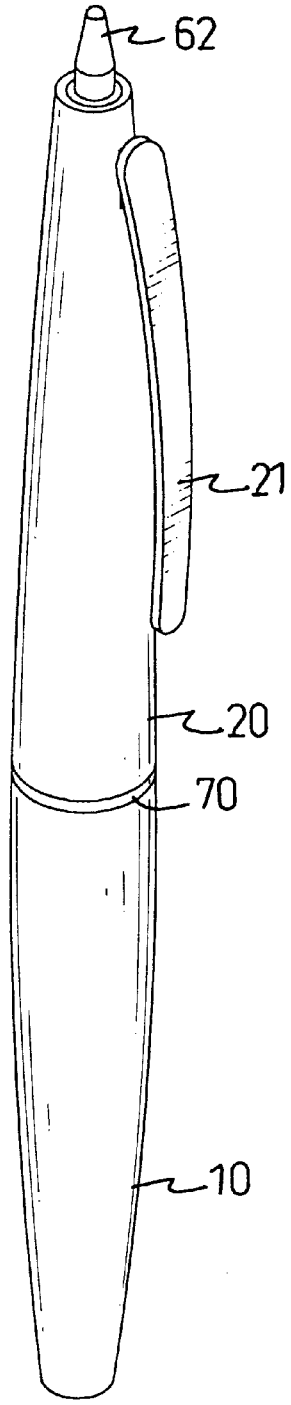
FIG. 1 is a perspective view of a dual-purpose pen in accordance with the present invention.
Figure 2:
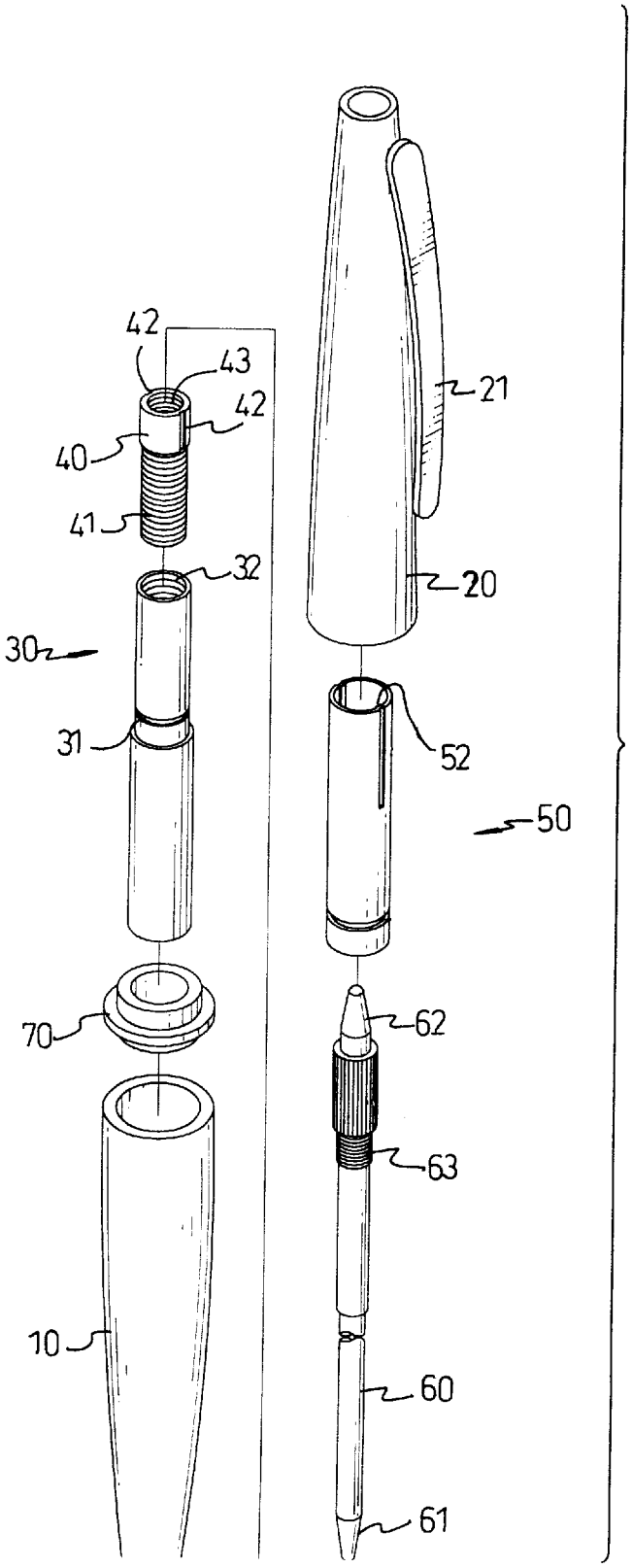
FIG. 2 is an exploded perspective view of the dual-purpose pen in FIG. 1.
Figure 4:
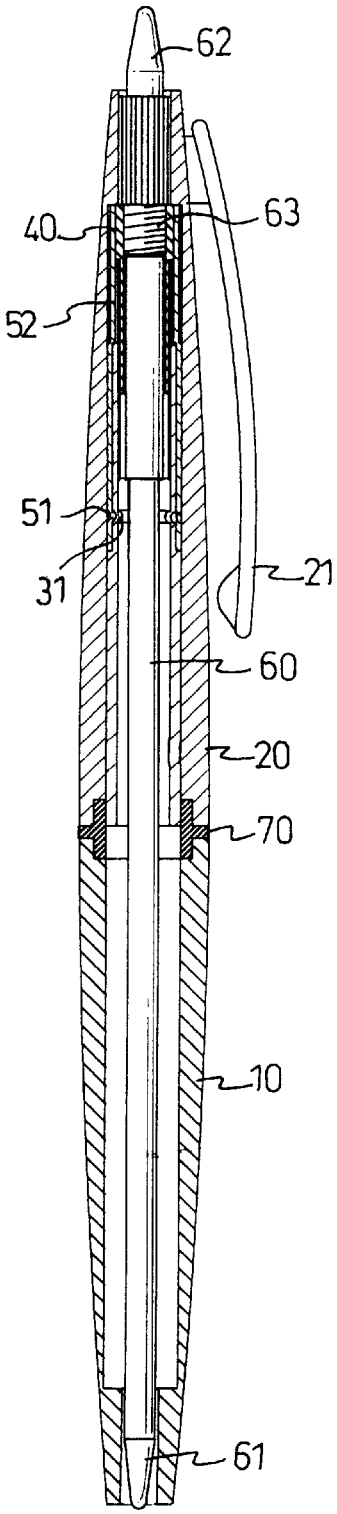
FIG. 4 is a cross sectional side plan view of the dual-purpose pen used as a key-pressing pen.
Figure 5:
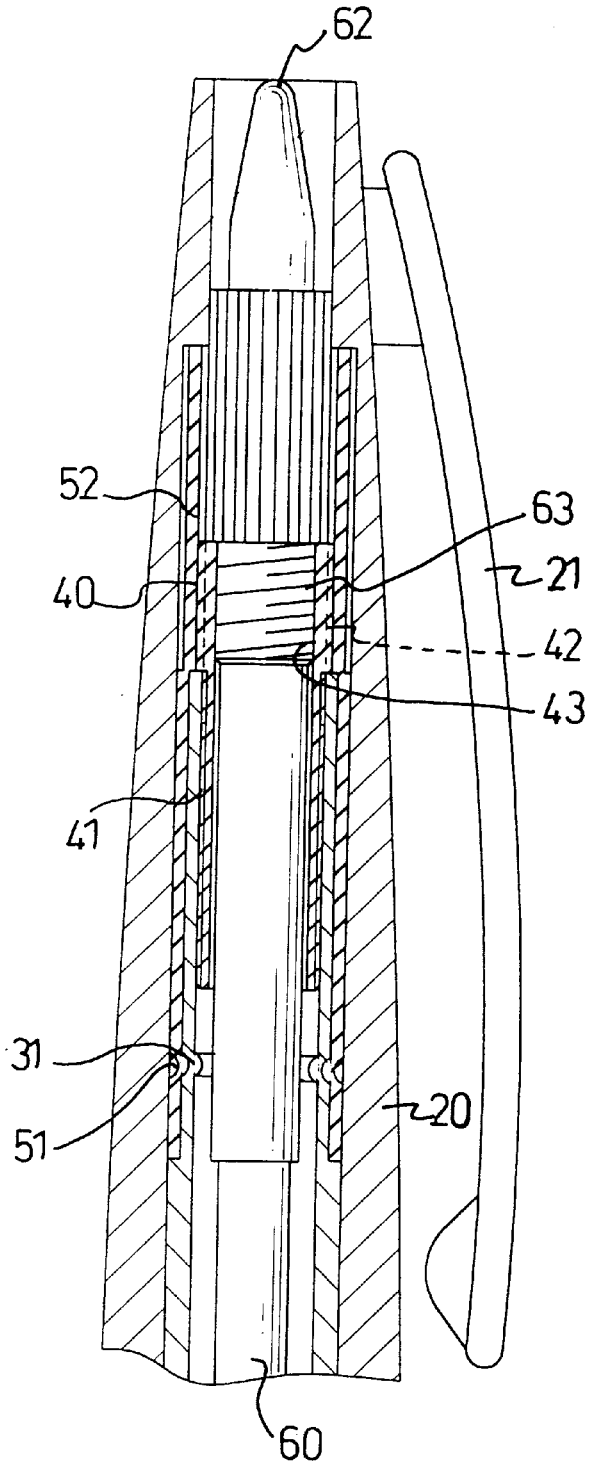
FIG. 5 is an enlarged partial sectional side plan view of the dual-purpose pen in FIG. 3.

With reference to FIGS. 1, 2 and 5, a dual-purpose pen in accordance with the present invention has a barrel (10), a cap (20), and a washer (70) between the barrel (10) and the cap (20). The cap (20) has a clip (21) formed or mounted on the outer periphery.

An inner sleeve (30) is provided on the washer (70) and received in the cap (20). A annular groove (31) is defined on an outer surface of the inner sleeve (30). A first female thread (32) is formed in the upper end of the inner sleeve (30).

A hollow screw (40) has a first male thread (41) defined on the lower portion of the outer surface and is screwed into the first female thread (32) in the inner sleeve (30). Two longitudinal grooves (42) are defined on diametrically opposite sides of the hollow screw (40). A second female thread (43) is defined inside the upper end of the hollow screw (40).

An outer sleeve (50) covering the hollow screw (40) and the upper portion of the inner sleeve (30) has a ring (51) pressed into the lower portion on the inner wall and two elongated ribs (52) pressed into the upper portion of the inner wall. The ring (51) is engaged with the annular groove (31) on the inner sleeve (30) and the elongated ribs (52) are respectively engaged with the longitudinal grooves (42) in the hollow screw (40), so that the outer sleeve (50) can turn the hollow screw (40). Moreover, the outer sleeve (50) is pressed tightly into the cap (20).

An ink cartridge (60) has a ball point (61) mounted at a first end inside the barrel (10) and a key-pressing point (62) mounted at a second end inside the cap (20). A second male thread (63) is formed near the top of the ink cartridge (60). The ink cartridge (60) is inserted through the hollow screw (40), and the second male thread (63) on the ink cartridge (60) is screwed into the second female thread (43) inside the hollow screw (40).

Figure 3:
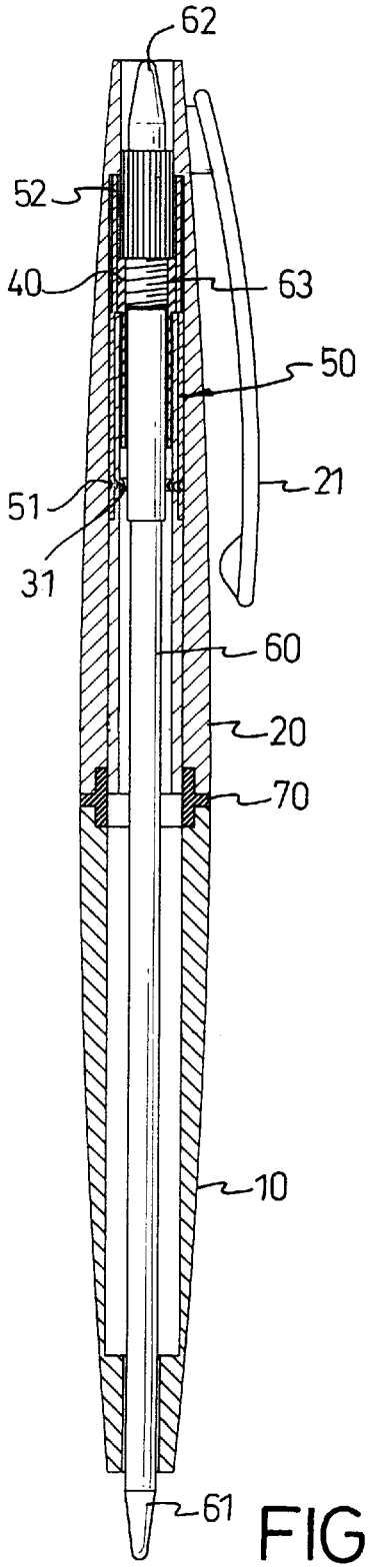
FIG. 3 is a cross sectional side plan view of the dual-purpose pen used as a general ball pen.

With reference to FIGS. 3 and 5, when the cap (20) is turned clockwise, the ribs (52) in the outer sleeve (50) engaged in the longitudinal grooves (42) in the hollow screw (40) turn the screw (40) clockwise, which moves the ink cartridge (60) downwards to extend the ball point (61) from the barrel (10) for writing. When the cap (20) is turned counterclockwise, the ink cartridge (60) is moved upwards to extend the key-pressing point (62) from the cap (20) for pressing keys on a notebook computer, electric calculator or the like.

Because the pen can be used for writing and pressing keys, it is very convenient for a user to write or press keys without looking for another instrument for writing.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A dual-purpose pen comprising:

a barrel (10);

a cap (20) engaged with the barrel (10);

a ball point (61) which is extendable from a first end of the barrel (10);

a key-pressing point (62) which is extendable from an end of the cap (20);

a washer (70) engaged between the barrel (10) and the cap (20);

an inner sleeve (30) pressed into the washer (70) and received in the cap (20) and having a first female thread (32) defined inside an upper end thereof;

a hollow screw (40) screwed into the inner sleeve (30) by a first male thread (41) defined at a lower end and having a second female thread (43) defined at an upper end;

an outer sleeve (50), which is fixed in the cap (20) and can turn the hollow screw (40) with itself, covering the hollow screw (40) and an upper portion of the inner sleeve (30); and an ink cartridge (60) passing through the inner sleeve (30) and the hollow screw (40) and having the ball point (61) formed at a first end, a key-pressing point (62) formed at a second end, and a second male thread (63) formed on an outer periphery near the key-pressing point (62) and screwed into the second female thread (43) in the hollow screw (40).

2. The dual-purpose pen as claimed in claim 1, wherein the hollow screw (40) has at least one longitudinal groove (42) defined in an outer surface, and the outer sleeve (50) has at least one longitudinal rib (52) formed in an inner wall and received in the longitudinal groove (42) in the hollow screw (40).

3. The dual-purpose pen as claimed in claim 1, wherein the inner sleeve (30) has an annular groove (31) defined in an outer surface, and the outer sleeve (50) has a ring (51) formed on an inner wall and received in the annular groove (31) of the inner sleeve (30).

4. The dual-purpose pen as claimed in claim 1, wherein the cap (20) has a clip (21) formed on an outer surface.

* * * * *